US005808337A

United States Patent [19]

Weimer et al.

[11] Patent Number: 5,808,337

[45] Date of Patent: Sep. 15, 1998

[54] TOTALIZER ASSEMBLY

[75] Inventors: Michael G. Weimer, Oconomowoc; David K. Wetzel, Watertown, both of Wis.

[73] Assignee: Eaton Corporation, Cleveland, Ohio

[21] Appl. No.: 514,418

[22] Filed: Aug. 11, 1995

[51] Int. Cl.[6] ..... G06M 1/00

[52] U.S. Cl. ..... 235/91 R; 235/91 PR; 235/91 G

[58] Field of Search ..... 235/91 R, 91 PR, 235/91 G, 103

[56] References Cited

U.S. PATENT DOCUMENTS

| | | | |
|---|---|---|---|
| 2,679,357 | 5/1954 | Rosenberger . | |
| 2,904,250 | 9/1959 | Allebach . | |
| 3,125,291 | 3/1964 | Komatar . | |
| 3,279,420 | 10/1966 | Zentmaier et al. . | |
| 3,362,632 | 1/1968 | Scurr et al. . | |
| 3,502,265 | 3/1970 | Vogtlin . | |
| 3,588,476 | 6/1971 | Lapointe | 235/117 |
| 3,735,102 | 5/1973 | Blancett | 235/94 R |
| 5,464,970 | 11/1995 | Nill et al. | 235/95 R |
| 5,574,268 | 11/1996 | Herman et al. | 235/91 R |

*Primary Examiner*—Michael L. Gellner
*Assistant Examiner*—Daniel Chapik
*Attorney, Agent, or Firm*—Tarolli, Sundheim, Covell Tummino & Szabo

[57] ABSTRACT

A totalizer assembly is enclosed in a housing having a base and a cover which cooperate to support and position a register assembly in the housing. The base and cover also cooperate to support and position a gear train in the housing. The gear train drives the register assembly. When units are to be totaled at a relatively fast rate, one gear train is used. When units are to be totaled at a relatively slow rate, a second gear train is used. The cover and base have surfaces for positioning the gears of either one of the two gear trains.

9 Claims, 6 Drawing Sheets

TOTALIZER ASSEMBLY

BACKGROUND OF THE INVENTION

The present invention relates to a totalizer assembly which is used to accumulate a count.

A known totalizer assembly includes a housing having side walls on which a number wheel support shaft and a tens transfer pinion support shaft are mounted. The number wheels must first be positioned in the housing and then positioned on the number wheel support shaft. Similarly, the tens transfer pinions must be first positioned in the housing and then positioned on the tens transfer pinion support shaft. The relatively limited amount of space available in the housing impedes the positioning of the number wheels on the number wheel support shaft and the tens transfer pinions on the tens transfer pinion support shaft.

The known totalizer assembly has previously been utilized in association with a fluid pump, that is, in association with a gasoline pump. The totalizer assembly has been supported on a plate. A gear drive assembly has been supported on a side of the plate opposite from the totalizer.

The gear drive assembly includes gears which drive the totalizer at a relatively fast rate when an English measurement of fluid flow is used, that is, when the fluid flow is measured in gallons. The gear drive assembly includes gears which drive the totalizer at a relatively slow rate when a metric measurement of fluid flow is used, that is, when the fluid flow is measured in liters. Since the gear drive assembly is outside of the totalizer housing, it is vulnerable to tampering.

SUMMARY OF THE INVENTION

The present invention relates to a totalizer assembly having a housing with a base and a cover which enclose a register assembly and a gear train which drives the register assembly. The base and cover have number wheel shaft positioning and support surfaces which allow a number wheel shaft of the register assembly to be positioned in the housing with the number wheels on the shaft. The base and cover also have tens transfer pinion shaft positioning and support surfaces which allow a tens transfer pinion shaft of the register assembly to be positioned in the housing with the tens transfer pinions on the shaft.

A gear train for driving the register assembly is disposed within the housing. When the totalizer assembly is to be used to total units at a first rate, a first gear train is mounted in the housing. When the totalizer assembly is to be used to total units at a second rate, a second gear train is mounted in the housing. The base and cover of the housing have supports for the gears of either the first gear train or the second gear train. Each of the gears of the gear train may be integrally formed as one piece with a shaft which supports the gear.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF ONE SPECIFIC PREFERRED EMBODIMENT OF THE INVENTION

General Description

Figure 1:
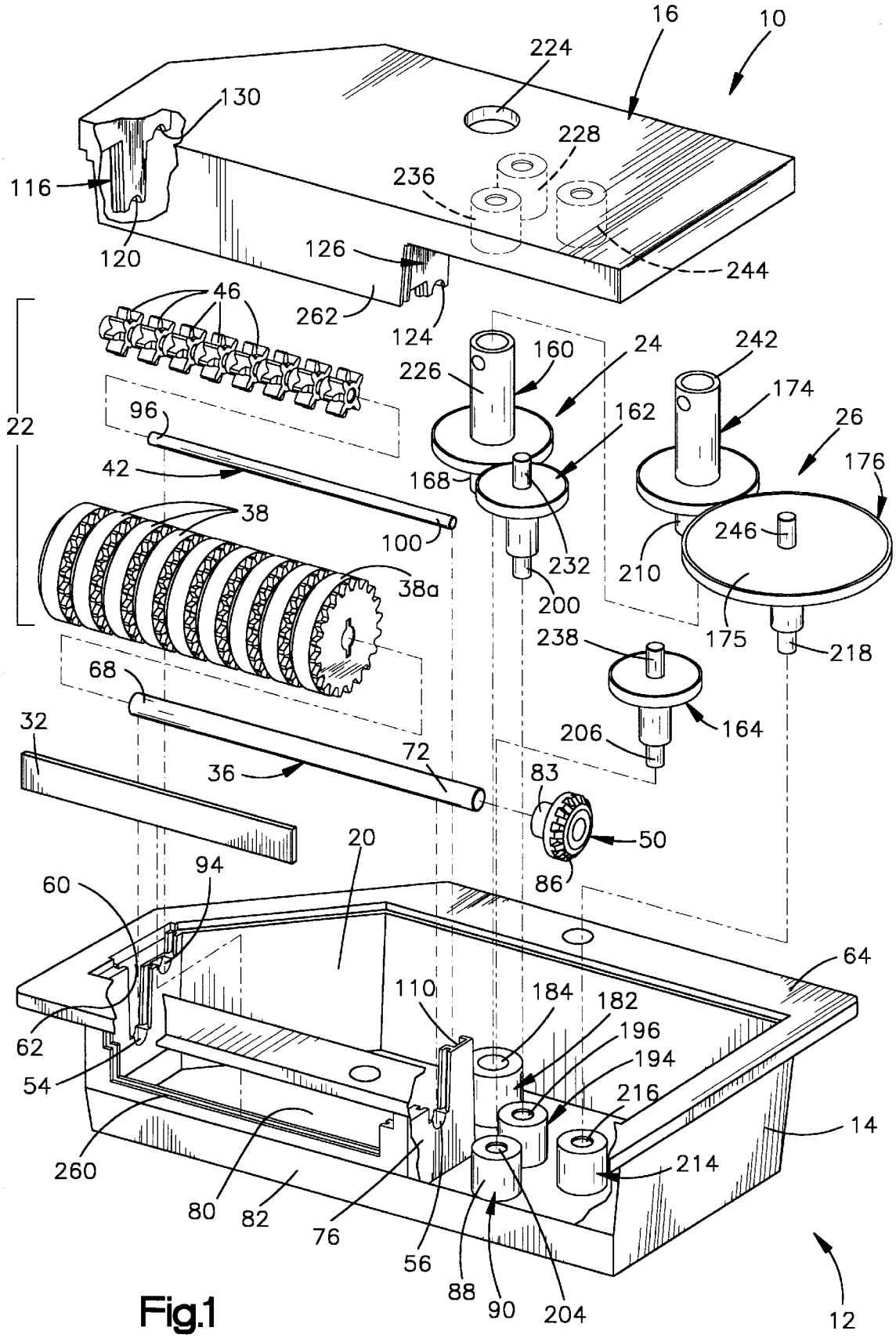
FIG. 1 is a simplified exploded schematic illustration of a totalizer assembly constructed in accordance with the present invention.
Figure 2:
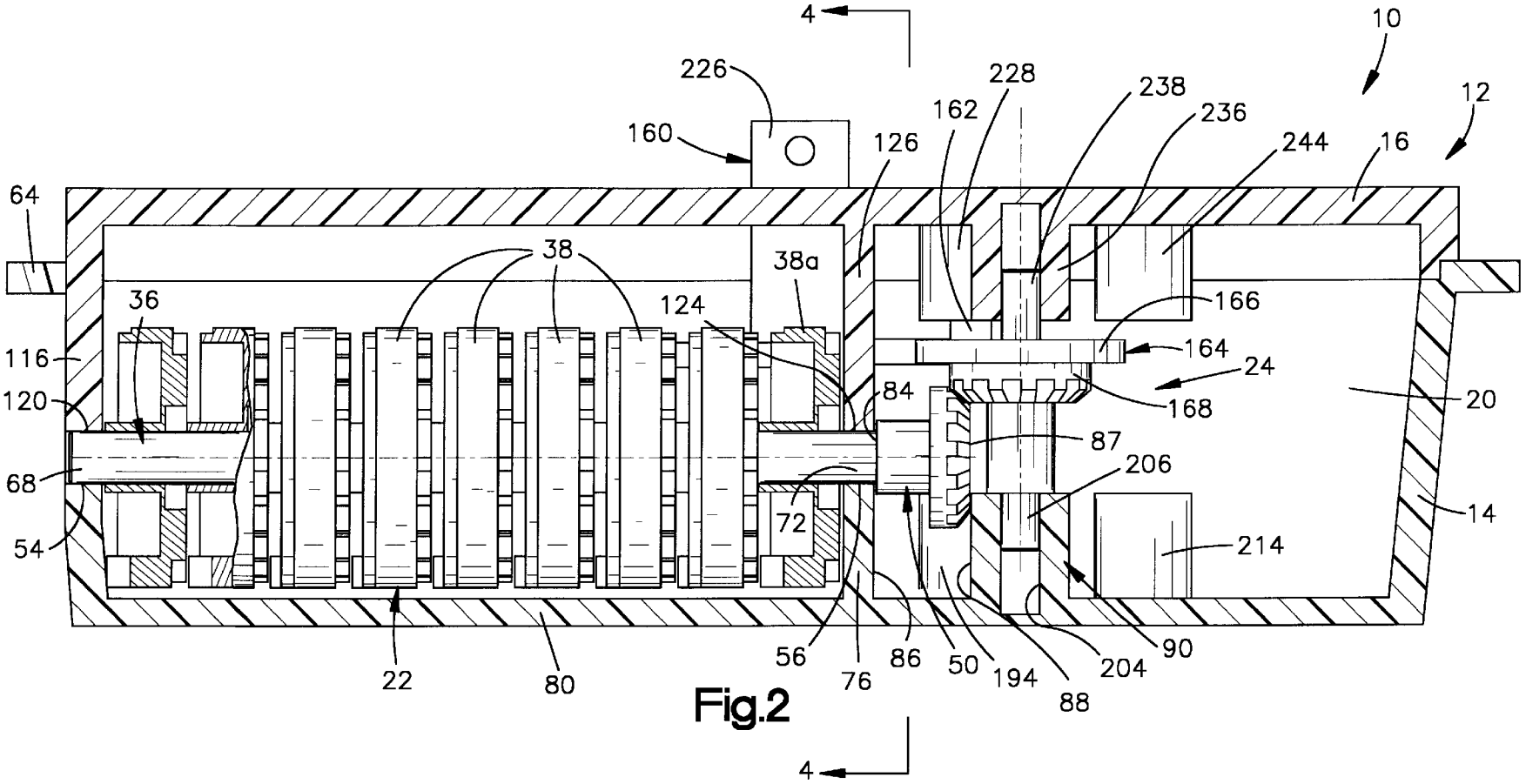
FIG. 2 is a schematic sectional view of the totalizer assembly of FIG. 1 in an assembled condition with components removed for purposes of clarity of illustration.

A totalizer assembly 10 constructed in accordance with the present invention is illustrated in FIGS. 1 and 2. The totalizer assembly 10 includes a housing 12 formed by a base 14 and cover 16. The base 14 is integrally molded as one piece. The cover 16 is also integrally molded as one piece. The cover 16 and base 14 may be formed of any suitable material. However, it is believed that it may be preferred to form the base 14 and cover 16 from polycarbonate filled with glass fiber and polytetrafluoroethylene.

The base 14 and cover 16 cooperate to form a chamber 20 in which a register assembly 22 is disposed. In addition, either one of two gear trains 24 or 26 (FIG. 1) is disposed in the chamber 20 to drive the register assembly 22. The gear train 24 drives the register assembly 22 at a relatively fast speed. The gear train 26 drives the register assembly 22 at a relatively slow speed.

When the totalizer assembly 10 is used in association with a fluid pump, such as a gasoline pump, the gear train 24 is used to drive the register assembly 22 to count gallons of fluid. Alternatively, the gear train 26 may be used to drive the register assembly 22 to count liters of fluid. However, it should be understood that the totalizer assembly 10 may be used in association with devices other than pumps to count units other than units of fluid.

A joint 28 (FIG. 2) between the cover 16 and base 14 is sealed by ultrasonic or heat welding. By sealing the joint 28 between the cover 16 and base 14, the housing 12 is made relatively tamper resistant to block unauthorized access to the register assembly 22.

A window 32 (FIG. 1) is provided in the housing 12. The window 32 allows the count in the register 22 to be viewed once the joint 28 between the cover 16 and base 14 has been sealed. Since the count in the register assembly 22 can be viewed through the transparent window 32, it is unnecessary to open the housing 12.

The register assembly 22 has a known construction and includes a cylindrical number wheel shaft 36 on which a plurality of number wheels 38 are disposed in a linear array (FIG. 2). The first number wheel, designated 38*a* in FIGS. 1 and 2, is fixedly connected with the number wheel shaft 36 and rotates with the shaft. The number wheels 38 other than the number wheel 38*a*, are rotatably supported on the number wheel shaft 36 and are free to rotate relative to the number wheel shaft.

A cylindrical tens transfer pinion shaft 42 (FIG. 1) extends parallel to the number wheel shaft 36. Although the tens transfer pinion shaft 42 has been omitted in FIG. 2, for purposes of clarity of illustration, the tens transfer pinion shaft 42 is mounted adjacent to the periphery of the number wheels 38. Tens transfer pinions 46 (FIG. 1) are rotatably mounted on the tens transfer pinion shaft 42 and engage the number wheels 38.

The tens transfer pinions 46 transfer a count from a lower order number wheel 38 to a higher order number wheel each time the lower number order wheel makes one complete revolution. Each of the tens transfer pinions 46 has four teeth which engage a cylindrical outer side surface area of a lower order number wheel 38. Each of the tens transfer pinions 46 has a set of eight teeth which mesh with gear teeth on the next higher order number wheel. On each of the tens transfer pinions 46, a set of eight teeth is coaxial with and disposed closely adjacent to a set of four teeth.

When the lower order number wheel has been rotated through one complete revolution, one tooth of the set of four teeth on a tens transfer pinion associated with the lower order number wheel engages an recess in the cylindrical outer side surface of the lower order number wheel and is rotated through a quarter of a revolution. Rotation of a tens transfer pinion through a quarter of a revolution rotates the next higher order number wheel through one-tenth of a revolution. Numerical indicia from 0 through 9 (not shown) is provided on each of the number wheels 38 and is visible through the windows 32.

In accordance with one of the features of the present invention, the base 14 of the housing 12 has surfaces for positioning and supporting the number wheel shaft 36 and tens transfer pinion shaft 42 in a parallel relationship. This enables the number wheels 38 and a number wheel drive gear 50 to be mounted on the number wheel shaft 36 before the number wheel shaft is placed in the housing 12. In addition, the tens transfer pinions 46 can be rotatably mounted on the tens transfer pinion shaft 42 before the tens transfer pinion shaft is placed in the housing 12.

Thus, while the number wheel shaft 36 is at a location remote from the base 14, the first number wheel 38*a* and the number wheel drive gear 50 are fixedly secured to the number wheel shaft 36. The number wheels 38 other than the first number wheel 38*a* are positioned on the number wheel shaft 36 and are freely rotatable relative to the number wheel shaft. The subassembly of the number wheel shaft 36, number wheels 38 and number wheel drive gear 50 is then positioned, as a unit, in the chamber 20 in the base 14.

The tens transfer pinion shaft 42 and tens transfer pinions 46 are also mounted as a unit in the chamber 20 in the base 14. Thus, at a location remote from the base 14, the tens transfer pinions 46 are positioned on the tens transfer pinion shaft 42. The tens transfer pinion shaft 42, with the tens transfer pinions 46 rotatably mounted thereon, is then positioned in the chamber 20. As the tens transfer pinion shaft 42 is positioned in the base 14, the tens transfer pinions 46 are positioned in engagement with the number wheels 38. Since the entire register assembly 22 is positioned in the base 14 while the cover 16 is separate from the base, it is relatively easy to assemble the register assembly 22 in the base.

In accordance with another feature of the present invention, a selected gear train 24 or 26 is also positioned in the housing 12 while the cover 16 is separate from the base 14. The base 14 and cover 16 are provided with support and positioning surfaces which rotatably support and position the gears in either the gear train 24 or the gear train 26 relative to the base 14. If the totalizer assembly 10 is to be utilized to count gallons of fluid, the gear train 24 is mounted in the base 14 while the cover 16 is separate from the base. However, if the totalizer assembly 10 is to be used to count liters of fluid, the gear train 26 is mounted in the base 14 while the cover 16 is separate from the base.

Once the register assembly 22 and desired one of the two gear trains 24 or 26 has been mounted in the base 14, the cover 16 is placed on the base 14. The cover 16 has surfaces for holding components of the register assembly 22 in place on the base 14. The cover 16 also has surfaces for holding the gears in the selected gear train 24 or 26 in place on the base 14. In addition, the cover 16 holds the window 32 in place on the base 14.

Register Assembly Mounting

In order to enable the number wheel shaft 36 of the register assembly 22 to be mounted on the base 14 with the number wheels 38 and number wheel drive gear 50 on the shaft 36, number wheel shaft positioning and support surfaces 54 (FIGS. 1 and 3) and 56 (FIGS. 1 and 4) are disposed on the base 14. The number wheel shaft support surfaces 54 and 56 are integrally formed as one piece with the base 14. The number wheel shaft support surfaces 54 and 56 have coincident central axes.

The number wheel shaft support surface 54 is disposed at the lower end of a recess 60 (FIG. 3) formed in a side wall 62 of the base 14. The recess 60 extends downward from a mounting flange 64 which extends around the base 14 (FIG. 1). The recess 60 (FIG. 3) extends through the side wall 62 of the base 14. The number wheel shaft support surface 54 is disposed at the lower end (FIG. 3) of the recess 60.

The number wheel shaft support surface 54 is formed as one-half of a cylinder and has semicircular cross sectional configuration. The number wheel support shaft surface 54 engages a cylindrical end portion 68 of the number wheel shaft 36. The number wheel shaft support surface 54 forms a bearing surface which rotatably supports the end portion 68 of the number wheel shaft 36. In addition, the number wheel shaft support surface 54 positions the end portion 68 of the number wheel shaft 36 relative to the base 14. The diameter of the number wheel shaft support surface 54 is slightly greater than the diameter of the number wheel shaft 36.

An axially opposite end portion 72 (FIG. 4) of the number wheel shaft 36 is rotatably supported and positioned by the number wheel shaft support surface 56. The number wheel shaft support surface 56 is formed in a recess 74 in an interior support wall 76. The interior support wall 76 is formed as a portion of the base 14 and is disposed in the chamber 20 in the base (FIG. 1). The interior support wall 76 extends parallel to the side wall 62 in which the number wheel shaft support surface 54 is disposed.

The number wheel shaft support surface 56 is formed as one-half of a cylinder and has a semicircular cross sectional configuration. The center of curvature of the number wheel shaft support surface 56 on the interior support wall 76 (FIG. 4) is aligned with the center of curvature of the number wheel shaft support surface 54 (FIG. 3) in the side wall 62 of the base 14. The diameter of the number wheel shaft support surface 56 is the same as the diameter of the number wheel shaft support surface 54.

Coincident central axes of the number wheel shaft support surfaces 54 and 56 extend parallel to a bottom wall 80 (FIG. 1) and front wall 82 of the base 14. The bottom wall 80 of the base 14 extends perpendicular to the interior support wall 76, side wall 62, and front wall 82 of the base. The side wall 62, interior support wall 76, bottom wall 80 and front wall 82 of the base 14 are integrally molded as one piece.

The number wheel shaft 36 is positioned axially relative to the open ended number wheel support surfaces 54 and 56 by the number wheel drive gear 50 (FIG. 1). The number wheel drive gear 50 is fixedly connected to the end portion 72 of the number wheel shaft 36. The number wheel drive gear 50 has a cylindrical hub 83 (FIG. 1) with a circular end face 84 (FIG. 2) which abuttingly engages a flat side surface 86 of the interior support wall 76.

The number wheel drive gear 50 is a bevel gear and has an annular end surface 87 which extends parallel to the end face 84 (FIG. 2). The annular end surface 87 on the number wheel drive gear 50 engages a cylindrical outer side surface 88 of a gear positioning collar or boss 90. The cylindrical outer side surface 88 on the gear positioning collar 90 has a central axis which extends perpendicular to and intersects the coincident central axes of the number wheel shaft support surfaces 54 and 56. Engagement of the end surfaces 84 and 87 of the number wheel drive gear 50 with the interior support wall 76 and the gear positioning collar 90 positions the number wheel drive gear 50 and the number wheel shaft 36 axially relative to the housing 12.

The tens transfer pinion shaft 42 is supported by the base 14 in the same general manner as in which the number wheel shaft 36 is supported by the base. Thus, the recess 60 (FIG. 3) in the side wall 62 of the base 14 is provided with a tens transfer pinion shaft support surface 94. The tens transfer pinion shaft support surface 94 is formed as half of a cylinder and has a semicircular cross sectional configuration. The tens transfer pinion shaft support surface 94 positions and supports a cylindrical end portion 96 of the tens transfer pinion shaft 42.

An opposite end portion 100 of the tens transfer pinion shaft 42 (FIG. 4) engages a tens transfer pinion shaft support surface 104 formed in the interior support wall 76. The tens transfer pinion shaft support surface 104 is formed as half of a cylinder and has a semicircular cross sectional configuration. The tens transfer pinion shaft support surface 104 positions and supports the cylindrical end portion 100 of the tens transfer pinion shaft 42.

The tens transfer pinion shaft support surfaces 94 and 104 are integrally formed as one piece with the base 16. The center of curvature of the tens transfer pinion shaft support surface 104 is aligned with the center of curvature of the tens transfer pinion shaft support surface 94 (FIG. 3) in the side wall 62. Therefore, the longitudinal central axes of the tens transfer pinion shaft support surfaces 94 and 104 are coincident. The coincident longitudinal central axes of the tens transfer pinion shaft support surfaces 94 and 104 extend parallel to the coincident longitudinal central axes of the number wheel shaft support surfaces 54 and 56.

Figure 3:
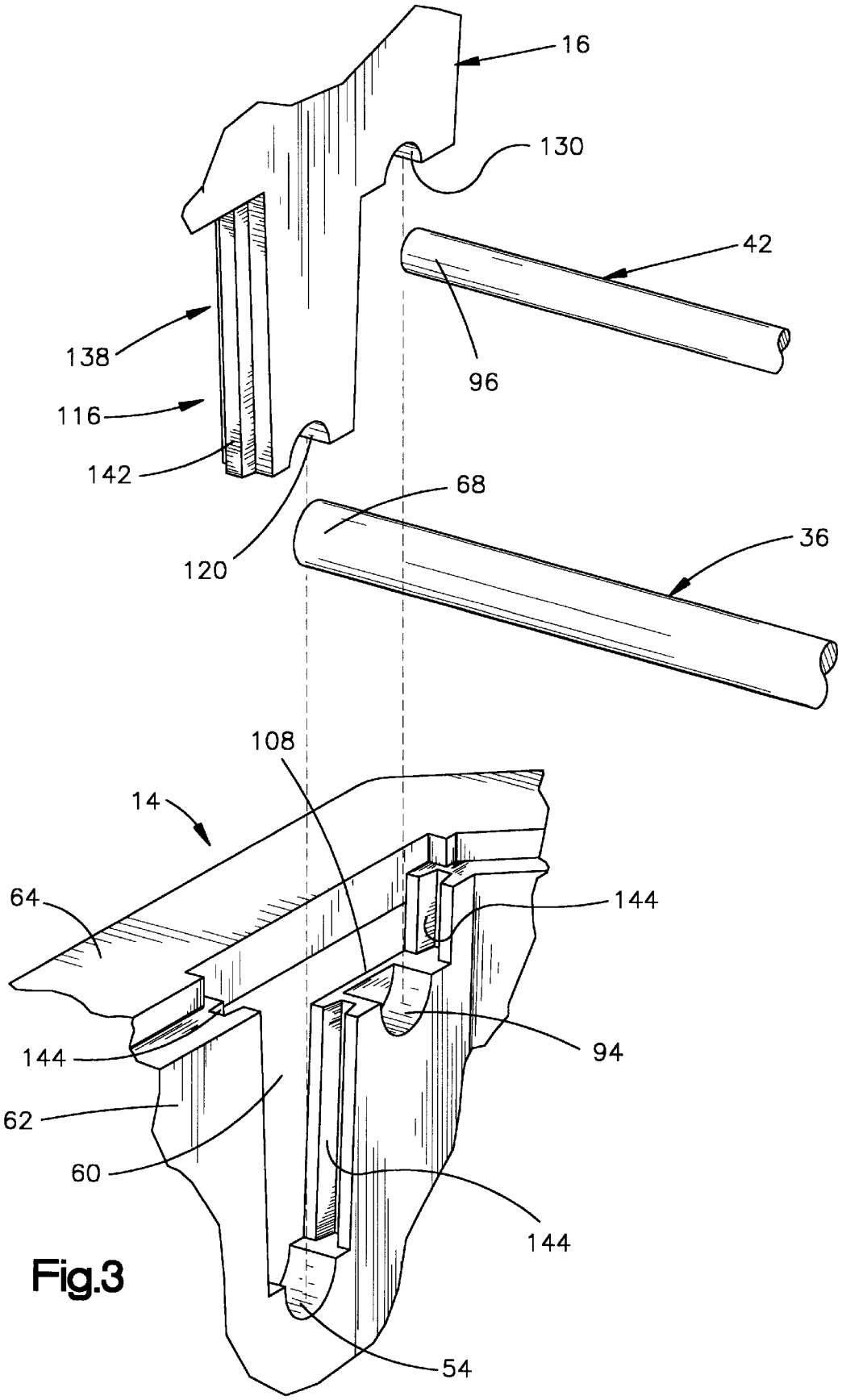
FIG. 3 is an enlarged fragmentary schematic illustration depicting the relationship between end portions of a number wheel shaft and a tens transfer pinion shaft and shaft positioning surfaces on a base and cover of a housing of the totalizer of FIG. 1.

The tens transfer pinion shaft 42 is positioned axially relative to the base 14 by positioning surfaces which engage opposite ends of the tens transfer pinion shaft 42. Thus, a panel 108 (FIG. 3) extends across the axially outer end of the tens transfer pinion shaft support surface 94 and engages a circular end of the tens transfer pinion shaft 42. Similarly, a panel 110 extends across the end of the tens transfer pinion shaft support surface 104 (FIG. 4) and engages the opposite axial end of the tens transfer pinion shaft 42. The panel 110 extends parallel to the panel 108 (FIG. 3).

The cover 16 cooperates with the base 14 to hold the number wheel shaft 36 and the tens transfer pinion shaft 42 in place in the chamber 20. Thus, the cover 16 has an exterior extension section 116 (FIGS. 1 and 3) which extends into the recess 60 in the side wall 62. The cover 16 also has an interior extension section 126 (FIGS. 1 and 4) which extends into the recess 74 in the interior support wall 76.

The exterior extension section 116 of the cover 16, has an arcuate number wheel shaft positioning surface 120 (FIG. 3) which engages an upper side of the end portion 68 of the number wheel shaft 36. The number wheel shaft positioning surface 120 is formed as half of a cylinder having the same diameter as the number wheel shaft support surface 54 on the side wall 62 of the base 14. The number wheel shaft positioning surface 120 and the number wheel shaft support surface 54 cooperate to form a cylindrical recess which receives and rotatably supports the cylindrical end portion 68 of the number wheel shaft 36 (FIG. 3).

The opposite end portion 72 (FIGS. 1 and 4) of the number wheel shaft 72 is engaged by a number wheel shaft positioning surface 124 on the interior extension section 126. The interior extension section 126 extends downward from the cover 16 and is parallel to the exterior extension section 116. The number wheel shaft positioning surface 124 on the interior extension section 126 is formed as one-half of a cylinder and has a semicircular cross sectional configuration.

The center of curvature of the number wheel shaft positioning surface 124 on the interior extension section 126 (FIG. 4) is axially aligned with the center of curvature of the number wheel shaft positioning surface 120 (FIG. 3) on the exterior extension section 116. When the cover 16 is closed on the base 14 (FIG. 2), the coincident central axes of the number wheel shaft positioning surfaces 120 and 124 on the exterior and interior extension sections 116 and 126 are coincident with the central axes of the number wheel shaft support surfaces 54 and 56 on the side wall 62 and interior support wall 76. Therefore, the opposite end portions 68 and 72 of the number wheel shaft 36 are rotatably supported in coaxial cylindrical openings formed by the number wheel shaft support surfaces 54 and 56 (FIGS. 3 and 4) on the base 14 and the number wheel shaft positioning surfaces 120 and 124 on the cover 16.

The tens transfer pinion shaft 42 is retained in engagement with the tens transfer pinion shaft support surfaces 94 and 104 (FIGS. 3 and 4) on the base 14 by positioning surfaces connected with the cover 16. Thus, a tens transfer pinion shaft positioning surface 130 (FIG. 3) is disposed on the exterior extension section 116 of the cover 16. The tens transfer pinion shaft positioning surface 130 is formed as one-half of a cylinder and has a semicircular cross sectional configuration. The tens transfer pinion shaft positioning surface 130 on the exterior extension section 116 of the cover 16 cooperates with the tens transfer pinion shaft support surface 94 on the side wall 62 of the base 14 to form a cylindrical recess in which the end portion 96 of the tens transfer pinion shaft is received.

Figure 4:
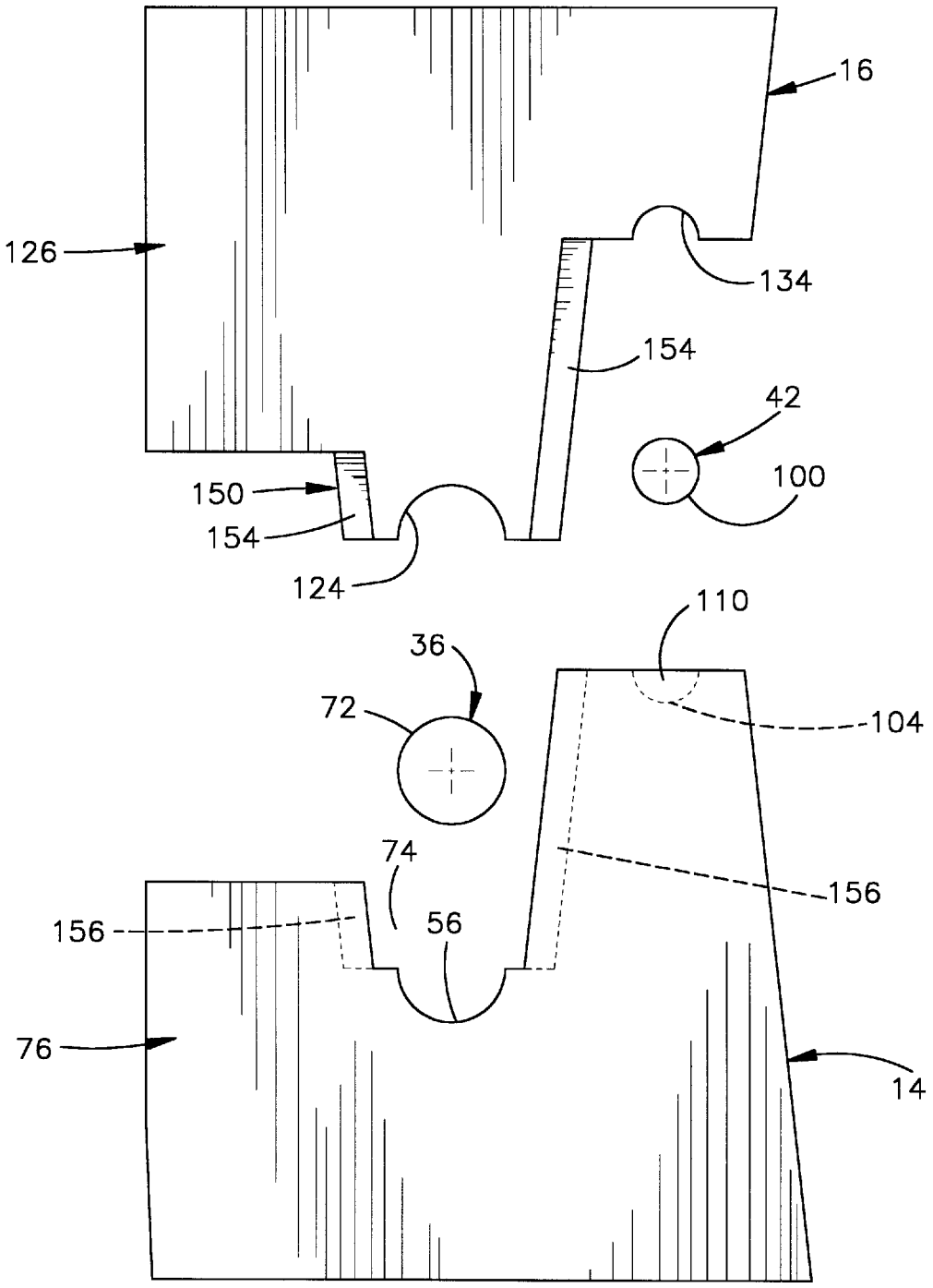
FIG. 4 is an end view, taken generally along the line 4—4 of FIG. 2, illustrating the relationship between the number wheel shaft and tens transfer pinion shaft and shaft positioning surfaces on the base and cover of the housing.

Similarly, a tens transfer pinion shaft positioning surface 134 is disposed on the interior extension section 126 (FIG. 4). The tens transfer pinion shaft positioning surface 134 is formed as one-half of a cylinder and has a semicircular configuration. The tens transfer pinion shaft positioning surface 134 cooperates with the tens transfer pinion shaft support surface 104 on the interior support wall 76 to form a cylindrical recess in which the end portion 100 of the tens transfer pinion shaft 42 is received.

The center of curvature of the tens transfer pinion shaft positioning surface 134 on the interior extension section 126 (FIG. 4) is axially aligned with the center of curvature of the tens transfer pinion shaft positioning surface 130 (FIG. 3) on the exterior extension section 116. Thus, the tens transfer pinion shaft positioning surface 134 on the interior extension section 126 has a central axis which is coincident with the central axis of the tens transfer pinion shaft positioning surface 130 on the exterior extension section 116. The coincident central axes of the tens transfer pinion shaft positioning surfaces 130 and 134 (FIGS. 3 and 4) extend parallel to the coincident central axes of the number wheel shaft positioning surfaces 120 and 124 on the cover 16.

When the cover 16 is connected with the base 14 (FIG. 2), the tens transfer pinion shaft support surfaces 94 and 104 (FIGS. 3 and 4) on the base 14 cooperate with the tens transfer pinion shaft positioning surfaces 130 and 134 on the cover 16 to hold the tens transfer pinion shaft 42 in a parallel relationship with the number wheel shaft 36. Although the number wheel shaft 36 rotates relative to the base 14 and cover 16 during operation of the register assembly 22, the tens transfer pinion shaft 42 does not rotate relative to the base 14 and cover 16. However, the tens transfer pinion shaft 42 supports the tens transfer pinions 46 (FIG. 1) for rotation relative to the base 14 and cover 16.

The exterior and interior extension sections 116 and 126 (FIG. 1) on the cover 16 are accurately positioned relative to the base 14. Thus, tongue and groove connections 138 (FIG. 3) are provided between the exterior extension section 116 on the cover 16 and the side wall 62 on the base 14. The tongue and groove connection 138 includes tongues 142 which extend outward from opposite sides of the exterior extension section 116. Although only one of the tongues 142 has been shown in FIG. 3, it should be understood that a similar tongue is provided on the opposite side of the exterior extension section 116.

The side wall 62 of the base 14 is provided with grooves 144. The tongues 142 on the exterior extension section 116 extend into the grooves 144 when the cover 16 is positioned on the base 14. The tongues 142 engage the grooves 144 to accurately position the number wheel shaft positioning surface 120 and tens transfer pinion shaft positioning surface 130 relative to the number wheel shaft support surface 54 and tens transfer pinion shaft support surface 94 on the base 14.

The interior extension section 126 is provided with a tongue and groove connection 150 (FIG. 4) which positions the interior extension section 126 on the cover 16 relative to the interior support wall 76 on the base 14. Thus, tongues 154 on the interior extension section 126 engage grooves 156 on the interior support wall 76. The tongue and groove connection 150 accurately positions the number wheel shaft positioning surface 124 and tens transfer pinion shaft positioning surface 134 on the cover 16 relative to the number wheel shaft support surface 56 and tens transfer pinion shaft support surface 104 on the interior support wall 76.

Gear Train Mounting

The cover 16 and base 14 (FIG. 1) cooperate to position and support either a gear train 24 or a gear train 26. The gear train 24 drives the register assembly 22 at a relatively fast rate when fluid flow units are to be counted in gallons. The gear train 26 drives the register assembly 22 at a relatively slow rate when fluid flow units are to be counted in liters. The base 14 and cover 16 have support surfaces for supporting the selected one of the two gear trains 24 and 26.

The first gear train 24 includes an input gear 160 (FIG. 1). The input gear 160 is disposed in meshing engagement with an intermediate gear 162. The intermediate gear 162 is disposed in meshing engagement with an output gear 164. The output gear 164 has a spur tooth section 166 (FIG. 2) which is disposed in meshing engagement with the intermediate gear 162. In addition, the output gear 164 has a bevel gear section 168 which is disposed in meshing engagement with the number wheel drive gear 50.

Figure 9:
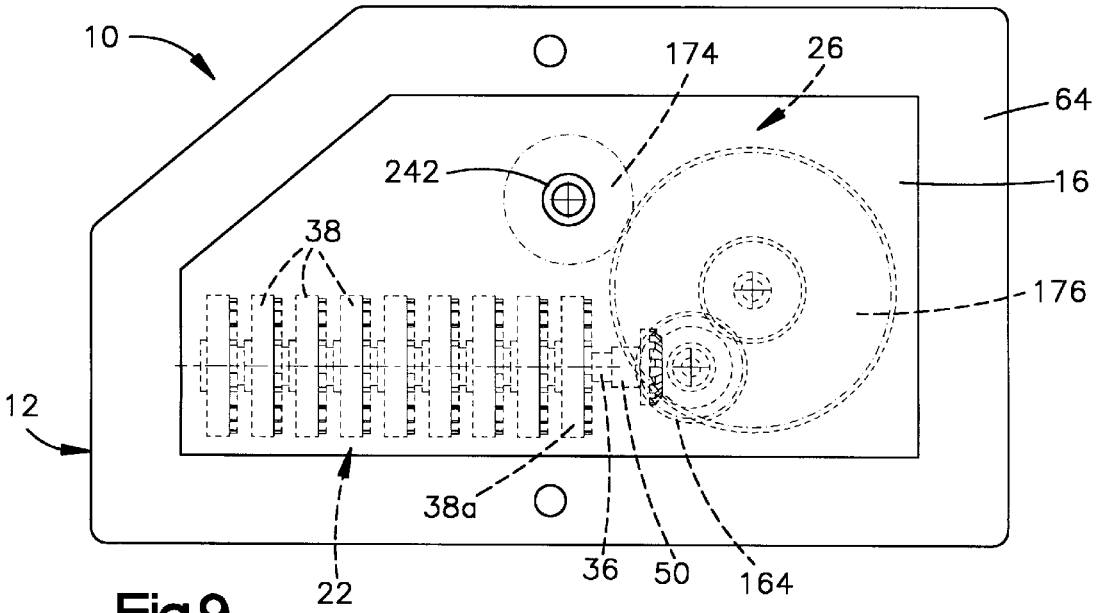
FIG. 9 is a top plan view of the totalizer assembly of FIG. 1 with a second gear train disposed within the housing to drive the register assembly.

The second gear train 26 has the same general construction as the first gear train 24. Thus, the second gear train 26 includes an input gear 174 which is disposed in meshing engagement with a relatively large diameter upper spur gear section 175 (FIG. 9) of an intermediate gear cluster 176. The intermediate gear cluster 176 has a lower spur gear section 178 which is disposed in meshing engagement with the output gear 164. A substantial number of revolutions of the input gear 174 are required to rotate the intermediate gear 176 through one complete revolution.

In one specific embodiment of the gear train 24, the input gear 160 (FIG. 7) had thirty teeth. The intermediate gear 162 also had thirty teeth. The output gear 164 had a spur tooth section 164 with twenty-four teeth. The bevel gear section 168 of the output gear 164 had the same number of teeth as the number wheel drive gear 50.

In one specific embodiment of the gear train 26 (FIG. 9), the input gear 174 had thirty teeth. The intermediate gear cluster 176 had a large diameter upper spur gear section 175 (FIG. 9) with sixty-two teeth and a relatively small diameter lower spur gear section 178 with twenty-two teeth. The output gear 164 had a spur tooth section 164 with twenty-four teeth. The bevel gear section 168 of the output gear 164 had the same number of teeth as the number wheel drive gear 50. The two gear trains 24 and 26 use the same output gear 164 to drive the number wheel drive gear 50.

The foregoing description of specific gears for the gear trains 24 and 26 have been set forth herein only for purposes of clarity of description and not for purposes of limitation of the invention. It is contemplated that many different gears could be used in the gear trains 24 and 26 if desired. In fact, it is contemplated that gear trains for purposes of counting units other than gallons or liters may be used.

The base 14 and cover 16 (FIG. 1) have positioning surfaces which cooperate to position either the first gear train 24 or the second gear train 26 relative to the housing 12. When either the gear train 24 or the gear train 26 is to be mounted in the housing 12, the gears are positioned in the chamber 20 in the base 14 while the cover 16 is separate from the base. The gear positioning surfaces on the base 14 are capable of temporarily supporting and positioning the gears of either the first gear train 24 or second gear train 26 until the cover 16 is closed.

To position the input gear 160 (FIG. 1) of the gear train 24 relative to the base 14, a cylindrical input gear positioning collar or boss 182 is integrally formed as one piece with the base 14. The input gear positioning collar 182 has a cylindrical inner side or bearing surface 184 which engages a cylindrical shaft section 186 on the input gear 160 to rotatably support the input gear on the base 14. The cylindrical inner side surface 184 on the input gear positioning collar 182 has a central axis which extends perpendicular to the bottom wall 80 of the base 14. The central axis of the cylindrical inner side surface 184 on the input gear positioning collar 182 also extends perpendicular to the longitudinal central axes of the number wheel shaft 36 and the tens transfer pinion shaft 42.

A cylindrical intermediate gear positioning boss or collar 194 (FIG. 1) also extends upward from the bottom wall 80 of the base 14. The collar 194 is integrally formed as one piece with the base 14. The intermediate gear support collar 194 has a cylindrical inner side or bearing surface 196 with a longitudinal central axis which extends parallel to the longitudinal central axis of the cylindrical inner side surface 184 of the input gear positioning collar 182.

The intermediate gear 162 has a cylindrical shaft section 200 which is positioned in the intermediate gear support collar 194 to rotatably support the intermediate gear 162 in meshing engagement with the input gear 160. The intermediate gear 162 is supported by the intermediate gear positioning collar 194 for rotation about an axis which extends parallel to the axis about which the input gear 160 is supported for rotation by the input gear positioning collar 182.

The output gear 164 (FIG. 1) is supported by the output gear positioning collar 90. The output gear positioning collar 90 is formed as one piece with the base 14. The output gear positioning collar 90 has a cylindrical inner side or bearing surface 204 which engages a shaft section 206 (FIG. 2) on the output gear 164 to rotatably support the output gear. The output gear positioning collar 90 supports the output gear 164 for rotation about an axis which extends parallel to the axes about which the intermediate gear 162 and input gear 160 are supported. The inner side surface 204 of the output gear positioning collar 90 has a central axis which extends perpendicular to and intersects a central axis of the number wheel shaft 36.

If the second gear train 26 (FIG. 1) is to be used to drive the register assembly 22, a shaft section 210 on the input gear 174 is supported by the cylindrical inner side surface 184 on the input gear positioning collar 182. Since the intermediate gear cluster 176 in the gear train 26 has an upper spur gear section 175 with a substantially larger diameter than the intermediate gear 162 in the gear train 24, a cylindrical intermediate gear positioning collar 214 is provided on the base 14 to rotatably support the intermediate gear cluster 176. The intermediate gear positioning collar 214 has a cylindrical inner side or bearing surface 216 which engages a shaft section 218 on the intermediate gear cluster 176 to rotatably support the intermediate gear cluster. The inner side surface 216 on the intermediate gear positioning collar 214 has a central axis which is parallel to the central axis of the inner side surface 184 on the input gear positioning collar 182. The intermediate gear positioning collar 214 is spaced from the output gear positioning collar 90 by a distance which enables the output gear 164 to engage the lower spur gear section 178 (FIG. 9) on the intermediate gear cluster 176 when the intermediate gear is rotatably supported by the intermediate gear positioning collar 214 and the output gear 164 is rotatably supported by the output gear positioning collar 90.

The gear positioning collars 90, 182, 194, and 214 have an axial extent which is sufficient to support the gears of either the first gear train 24 or the second gear train 26. This enables the gear train 24 or the gear train 26 to be mounted in the chamber 20 in the base 14 while the cover 16 is spaced from the base. Thus, both the register assembly 22 and one of the gear trains 24 or 26 can be mounted in the base 14 before the cover 16 is connected with the base.

Figure 8:
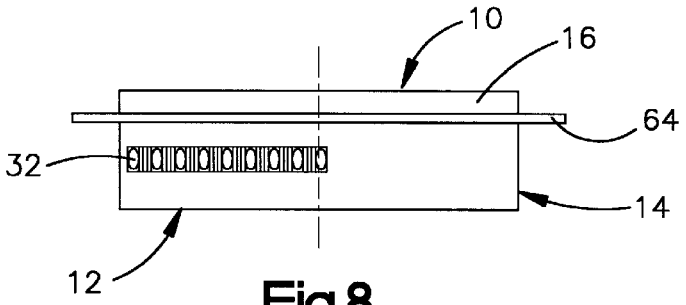
FIG. 8 is an elevational view, on a reduced scale and taken generally along the line 8—8 of FIG. 7, further illustrating the totalizer assembly.

The cover 16 (FIG. 1) cooperates with the gear positioning collars 90, 182, 194 and 214 on the base 14 to rotatably support the gears of either the gear train 24 or the gear train 26 for rotation about parallel axes. Thus, the cover 16 has a circular opening 224 through which a cylindrical tubular shaft section 226 of the input gear 160 extends (FIGS. 1 and 8). The shaft section 226 has a cylindrical outer side surfaces which engages a cylindrical side or bearing surface of the opening 224 to rotatably support the input gear 160.

The tubular shaft section 226 of the input gear 160 is adapted to be connected with a suitable drive member. It is contemplated that the drive member which is connected with the input gear 160 may be connected with an impeller of a fluid pump, such as a gasoline pump. The cylindrical inner side 184 of the input gear positioning collar 182 on the base 14 has a central axis which is coincident with the central axis of the opening 224 in the cover 16 when the cover is connected with the base 14. This results in the cover 16 and base 14 cooperating to support the input gear 160 for rotation about an axis which extends perpendicular to the bottom wall 80 of the base 14.

Figure 5:
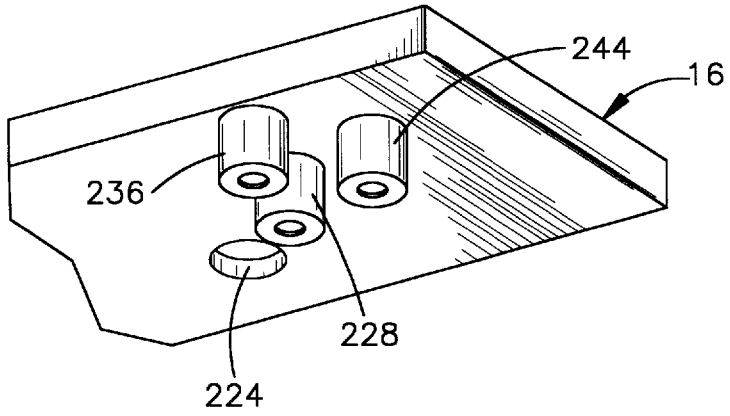
FIG. 5 is a fragmentary perspective illustration of gear positioning surfaces disposed on the cover of the housing.

The cover 16 has an intermediate gear positioning collar 228 which extends downward from the cover 16 (FIGS. 1, 2 and 5). The intermediate gear positioning collar 228 has a cylindrical inner side or bearing surface which is axially aligned with a cylindrical inner side surface 196 on the intermediate gear positioning collar 194 (FIG. 1) on the base 14. The intermediate gear 162 has a shaft section 232 which engages the cylindrical inner side surface of the intermediate gear positioning collar 228 on the cover 16.

An output gear positioning collar 236 (FIGS. 1, 2 and 5) extends downward from the cover 16 and is axially aligned with the output gear positioning collar 90 on the base 14. The output gear positioning collar 236 on the cover 16 has a cylindrical inner side or bearing surface which engages a shaft section 238 (FIG. 1) on the output gear 164. The cylindrical inner side surface of the output gear positioning collar 236 has a central axis which extends parallel to the central axes of the intermediate gear positioning collar 228 and the opening 224 in the cover 16.

The output gear positioning collar 236 on the cover 16 cooperates with the output gear positioning collar 90 on the base 14 to position the output gear 164 for rotation about an axis which extends perpendicular to the bottom wall 80 of the base 14. The output gear 164 rotates about an axis which extends parallel to the axes about which the input gear 160 and intermediate gear 162 rotate. The axis about which the output gear 164 rotates extends perpendicular to and intersects the longitudinal central axis of the number wheel support shaft 36.

When the gear train 26 is to be used to drive the register assembly 22, the input gear 174 (FIG. 1) is positioned with a tubular cylindrical shaft section 242 extending through the opening 224 in the cover 16. The shaft section 210 on the input gear 174 is rotatably supported by the cylindrical inner side or bearing surface 184 of the input gear positioning collar 182. Thus, the same bearing surfaces are used to rotatably support the input gear 174 of the gear train 26 as are used to support the input gear 160 of the gear train 24.

The intermediate gear cluster 176 for the gear train 26 is supported between the intermediate gear positioning collar 214 on the base 14 and an intermediate gear positioning collar 244 (FIGS. 1, 2 and 5) on the cover 16. The intermediate gear positioning collar 244 on the cover 16 has a cylindrical inner side or bearing surface which engages a shaft section 246 (FIG. 1) on the intermediate gear cluster 176. The intermediate gear positioning collar 244 on the cover 16 is axially aligned with the intermediate gear positioning collar 214 on the base 14. The intermediate gear cluster 176 rotates about an axis which is parallel to the axis about which the input gear 174 rotates.

When the intermediate gear cluster 176 is supported by the intermediate gear positioning collar 214 on the base 14 and the intermediate gear positioning collar 244 on the cover 16, the intermediate gear cluster is disposed in meshing engagement with the output gear 164. Thus, the same output gear 164 and bearing surfaces are used in the gear train 26 as were used in the gear train 24. The intermediate gear positioning collar 214 on the base is spaced further from the output gear positioning collar 90 on the base 14 than is the intermediate gear positioning collar 194 due to the relatively large diameter of the intermediate gear cluster 176.

Figure 6:
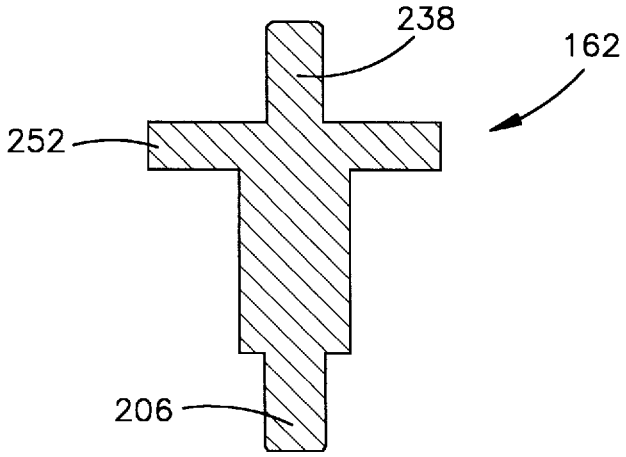
FIG. 6 is a simplified schematic sectional view of one of the gears used in the totalizer assembly of FIG. 1.

Each of the gears forming the two drive trains 24 and 26 is advantageously formed as one piece. Thus, the intermediate gear 162 (FIG. 6) of the gear train 24 has a circular spur gear toothed section 252 which is integrally formed as one piece with the cylindrical shaft sections 206 and 238. It is contemplated that the gear 162 will be molded of a suitable polymeric material containing a lubricant. Although only the gear 162 is shown in FIG. 6, it should be understood that the other gears in the gear trains 24 and 26 have shaft sections and gears which are integrally formed as one piece in the same manner as is the gear 162 of FIG. 6. However, if desired, the shaft sections could be formed separately from the gears.

When the input gear 160 or 174 is driven by a suitable drive shaft (not shown), the gear train 24 or 26 drives the register assembly 22. As the register assembly 22 is driven, the number wheel drive gear 50 rotates the number wheel shaft 36 and the first number wheel 38*a* which is fixedly connected with the number wheel shaft 36. During continued operation of the gear trains 24 and 26, the other number wheels 38 are driven as the count in the register assembly 22 increases.

Indicia (not shown) on the register wheels 38 indicating the count stored in the register assembly 22 is visible through the window 32. The window 32 is mounted in a slot 260 (FIG. 1) formed in the base 14. A downwardly extending slotted lip 262 on the cover 16 engages the opposite side of the window 32 to hold the window in place.

Assembly Method

When the totalizer assembly 10 is to be constructed, the number wheels 38 are positioned in a linear array on the number wheel shaft 36. The first number wheel 38*a* in the array of number wheels is fixedly connected with the number wheel shaft 36. In addition, the number wheel drive gear 50 is fixedly connected to the end portion 72 of the number wheel shaft.

The number wheel shaft 36, with the number wheels 38 disposed thereon, is then positioned in the open base 14. The end portion 68 of the number wheel shaft 36 is positioned in engagement with the number wheel shaft support surface 54. The end portion 72 of the number wheel shaft 36 is positioned in engagement with the number wheel shaft support surface 56. The number wheel drive gear 50 is positioned between the interior support wall 76 and the outer side surface 88 of the output gear positioning collar 90 (FIG. 2).

Once the number wheel shaft 36 and number wheels 38 have been positioned in the open chamber 20, the tens transfer pinion shaft 42 and tens transfer pinions 46 are positioned in the chamber. Before the tens transfer pinion shaft 42 is positioned in the chamber 20 in the base 14, the tens transfer pinions 46 are positioned on the tens transfer pinion shaft 42. The end portion 68 of the tens transfer pinion shaft 42 is then positioned in engagement with the tens transfer pinion shaft support surface 94. The end portion 100 of the tens transfer pinion shaft 42 is positioned in engagement with the tens transfer pinion shaft support surface 104 (FIG. 4). This results in the tens transfer pinion shaft being supported in a parallel relationship with the number wheel support shaft 36.

The tens transfer pinions 46 are freely rotatable on the tens transfer pinion shaft 42. As the tens transfer pinion shaft 42 is positioned in the base 14, the tens transfer pinions are positioned in engagement with the number wheels 38.

The gears for one of the two gear trains 24 or 26 are then positioned in the open chamber 20 in the base 14. Assuming that the gear train 24 is to be used, the lower shaft section 186 of the input gear 160 is positioned in engagement with the input gear positioning collar 182. The lower shaft section 200 of the intermediate gear 162 is positioned in engagement with the intermediate gear positioning collar 194. The lower shaft section 206 of the output gear 164 is positioned in the output gear positioning collar 90.

At this time, the input gear 160 is disposed in meshing engagement with the intermediate gear 162. The intermediate gear 162 is disposed in meshing engagement with the output gear 164. The bevel gear section 168 (FIG. 2) on the output gear 164 is disposed in meshing engagement with the number wheel drive gear 50.

The window 32 is then positioned in the slotted opening 260 in the open base 14. The slotted opening 260 in the base 14 aligns the window 32 with the number wheels 38 in the register assembly 22.

Once the register assembly 22, gear train 24 and window 32 have been positioned relative to the open base 14, the cover 16 is positioned on the base. As the cover 16 is positioned on the base, the number wheel shaft positioning surfaces 120 and 124 (FIGS. 3 and 4) on the cover 16 move into engagement with opposite end portions 68 and 72 of the number wheel shaft 36. At the same time, the tens transfer pinion shaft positioning surfaces 130 and 134 move into engagement with opposite end portions 96 and 100 of the tens transfer pinion shaft 42. This results in the number wheel shaft 36 and tens transfer pinion shaft 42 being firmly secured against movement relative to the housing 12.

Contemporaneously with engagement of the number wheel shaft 36 and tens transfer pinion shaft 42 by positioning surfaces on the cover 16, the gears in the gear train 24 are engaged by positioning surfaces on the cover. Thus, the circular opening 224 in the cover 16 is positioned around the upper shaft section 226 of the input gear 160. Immediately thereafter, the intermediate gear positioning collar 228 on the cover 16 moves into engagement with the upper shaft section 232 on the intermediate gear 162. At the same time, the output gear positioning collar 236 on the cover 16 moves into engagement with the upper shaft section 238 of the output gear 164. This results in the input gear 160, intermediate gear 162 and output gear 164 being rotatably supported by the base 14 and cover 16 for rotation about parallel axes which extend perpendicular to the bottom wall 80 of the base 14. The cover 16 is then connected with the base 14 by heat or electrosonic welding.

Figure 7:
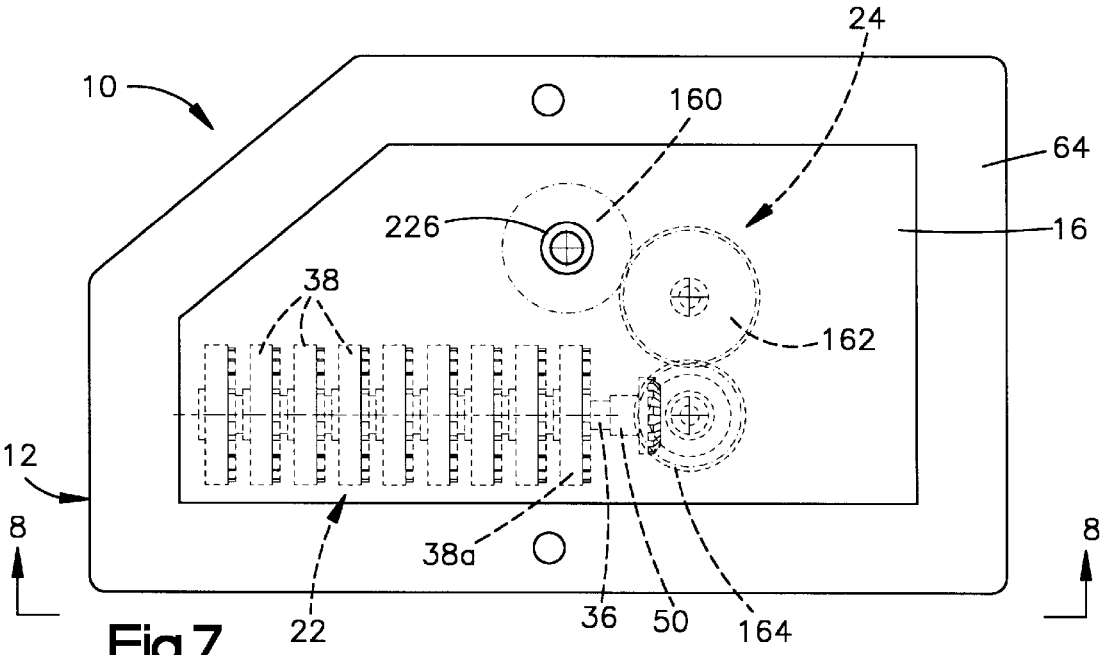
FIG. 7 is a top plan view of the totalizer assembly of FIG. 1 with a first gear train disposed within the housing to drive the register assembly.

Once the cover 16 has been connected with the base 14, the gear train 24 is held in the housing 14 in the manner illustrated in FIG. 7. Rotation of shaft section 226 of the input gear 160 by a fluid pump or other device results in rotation of the intermediate gear 162 and output gear 164. Rotation of the output gear 164 rotates the number wheel drive gear 50. The number wheel drive gear 50 is fixedly connected with the number wheel shaft 36 which is in turn fixedly connected with the first number wheel 38*a*. Therefore, rotation of the output gear 164 results in rotation of the first number wheel 38*a* in the register assembly 22.

As the first number wheel 38*a* in the register assembly 22 is rotated, the tens transfer pinions 46 (FIG. 1) effect rotation of the other number wheels in the register assembly in a known manner. Indicia on the number wheels 38 is exposed at the window 32 in the housing 12. Since the register assembly 22 and gear train 24 are enclosed within the housing and since the cover 16 has been securely welded to the base 14, the register assembly 22 cannot be tampered with by unauthorized personnel without damaging the housing 12 in such a manner as to make the occurrence of the unauthorized tampering clearly evident. Since the gear train 24 is disposed within the housing 12, the gear train is protected from the environment in which the totalizer assembly 10 is used. In addition, the gear train 24 is protected against tampering by the housing 12.

If the totalizer assembly 10 is to be assembled with the gear train 26 to drive the register assembly 22 at a relatively slow speed, the register assembly 22 is positioned in the open base 14 in the manner previously described. The lower shaft section 210 of the input gear 174 is positioned in the input gear positioning collar 182. The lower shaft section 218 of the intermediate gear cluster 176 is positioned in the intermediate gear positioning collar 214. The lower shaft section 206 of the output gear 164 is positioned in the output gear positioning collar 90. The window 32 is positioned on the base 14.

The cover 16 is then positioned on the base 14. As the cover 16 is positioned on the base, the number wheel shaft 36 and tens transfer pinion shaft 42 are engaged by positioning surfaces on the cover 16 in the manner previously explained. In addition, the opening 224 in the cover 16 is lowered onto the upper shaft section 242 of the input gear 174. Immediately thereafter, the intermediate gear positioning collar 244 and the output gear positioning collar 236 are positioned on the upper shaft sections 246 and 238 of the intermediate gear cluster 176 and output gear 164. The cover 16 is then fixedly connected with the base 14. Once the cover 16 has been fixedly connected with the base 14, the gear train 26 is positioned in the relationship shown in FIG. 9 relative to the register assembly 22.

Conclusion

In view of the foregoing description, it is apparent that the present invention relates to a totalizer assembly 10 having a housing 12 with a base 14 and a cover 16 which enclose a register assembly 22 and a gear train 24 or 26 which drives the register assembly. The base 14 and cover 16 have number wheel shaft positioning and support surfaces 54, 56, 120 and 124 which allow a number wheel shaft 36 of the register assembly 22 to be positioned in the housing with the number wheels 38 on the shaft. The base 14 and cover 16 also have tens transfer pinion shaft positioning and support surfaces 94, 104, 130, and 134 which allow a tens transfer pinion shaft 42 of the register assembly 22 to be positioned in the housing 12 with the tens transfer pinions 46 on the shaft.

A gear train 24 or 26 for driving the register assembly 22 is disposed within the housing 12. When the totalizer assembly 10 is to be used to total units at a first rate, a first gear train 24 is mounted in the housing 12. When the totalizer assembly 10 is to be used to total units at a second rate, a second gear train 26 is mounted in the housing 12. The base 14 and cover 16 of the housing 12 have supports 90, 182, 194, 214, 236, 238 and 244 for the gears of either the first gear train 24 or the second gear train 26. The gears of the gear trains 24 and 26 are integrally formed as one piece with the shaft sections.

Having described the invention, the following is claimed:

1. A totalizer assembly for use in totaling units at a first rate and for use in totaling units at a second rate which is different than the first rate, said totalizer assembly comprising a housing, said housing includes a base and a cover connected with said base, a plurality of number wheels disposed in said housing, a number wheel drive gear disposed in said housing and connected with one of said number wheels, and positioning means for positioning gears of a first gear train in said housing when units are to be totaled at the first rate and for positioning gears of a second gear train in said housing when units are to be totaled at the second rate, said first gear train including an input gear, an output gear which engages said number wheel drive gear, and at least one intermediate gear which transmits force along a path extending between said input and output gears, said second gear train including an input gear, an output gear which engages said number wheel drive gear, and at least one intermediate gear which transmits force along a path extending between said input and output gears, said positioning means including a first gear positioning means for positioning said input gear of said first gear train and said input gear of said second gear train for rotation about a first axis, second gear positioning means for positioning said output gear of said first gear train and said output gear of said second gear train for rotation about a second axis, third gear positioning means for positioning said intermediate gear of said first gear train for rotation about a third axis, and fourth gear positioning means for positioning said intermediate gear of said second gear train for rotation about a fourth axis which is spaced apart from said third axis, said first gear positioning includes a first cylindrical bearing surface means connected with said base of said housing and a second cylindrical bearing surface means connected with said cover of said housing, said first and second cylindrical bearing surface means having coincident central axes, said first and second cylindrical bearing surface means cooperating to support said input gear of said first gear train for rotation about the coincident central axes of said first and second cylindrical bearing surface means when units are to be totaled at the first rate, said first and second cylindrical bearing surface means cooperating to support said input gear of said second gear train for rotation about the coincident central axes of said first and second cylindrical bearing surface means when units are to be totaled at the second rate, said second gear positioning means includes a third cylindrical bearing surface means connected with said base of said housing and a fourth cylindrical bearing surface means connected with said cover of said housing, said third and fourth cylindrical bearing surface means having coincident central axes, said third and fourth cylindrical bearing surface means cooperating to support said output gear of said first gear train for rotation about the coincident central axes of said third and fourth cylindrical bearing surface means when units are to be totaled at the first rate, said third and fourth cylindrical bearing surface means cooperating to support said output gear of said second gear train for rotation about the coincident central axes of said third and fourth cylindrical bearing surface means when units are to be totaled at the second rate, said third gear positioning means includes a fifth cylindrical bearing surface means connected with said base of said housing and a sixth cylindrical bearing surface means connected with said cover of said housing, said fifth and sixth cylindrical bearing surface means having coincident central axes, said fifth and sixth cylindrical bearing surface means cooperating to support said intermediate gear of said first gear train for rotation about the coincident central axes of said fifth and sixth cylindrical bearing surface means when units are to be totaled at the first rate, said fourth gear positioning means includes seventh cylindrical bearing surface means connected with said base of said housing and an eighth cylindrical bearing surface means connected with said cover of said housing, said seventh and eighth cylindrical bearing surface means having coincident central axes, said seventh and eighth cylindrical bearing surface means cooperating to support said intermediate gear of said second gear train for rotation about the coincident central axes of said seventh and eighth cylindrical bearing surface means when units are to be totaled at the second rate.

2. A totalizer assembly as set forth in claim 1 further including a number wheel shaft disposed in said housing, said plurality of number wheels being disposed on said number wheel shaft between first and second end portions of said number wheel shaft, a tens transfer pinion shaft disposed in said housing, and a plurality of tens transfer pinions disposed on said tens transfer pinion shaft between first and second end portions of said tens transfer pinion shaft, said base including shaft positioning surface means for engaging said first and second end portions of said number wheel shaft and for engaging first and second end portions of said tens transfer pinion shaft, said cover including shaft positioning surface means for engaging said first and second end portions of said number wheel shaft and for engaging said first and second end portions of said tens transfer pinion shaft, said shaft positioning surface means on said cover being formed separately from said shaft positioning means on said base, said shaft positioning surface means on said base and said shaft positioning surface means of said cover cooperating to support said number wheel shaft and said tens transfer pinion shaft in said housing with longitudinal central axes of said number wheel shaft and said tens transfer pinion shaft extending transversely to central axes of said first, second, third, fourth, fifth, sixth, seventh and eighth cylindrical bearing surface means.

3. A totalizer assembly as set forth in claim 2 wherein said shaft positioning surface means on said base includes a first semicircular surface area disposed on said base and disposed in engagement with said first end portion of said number wheel shaft and a second semicircular surface area disposed on said base and disposed in engagement with said second end portion of said number wheel shaft, said shaft positioning surface means on said cover including a first semicircular surface area disposed on said cover and disposed in engagement with said first end portion of said number wheel shaft and a second semicircular surface area disposed on said cover and disposed in engagement with said second end portion of said number wheel shaft, said shaft positioning surface means on said base includes a third semicircular surface area disposed on said base and disposed in engagement with said first end portion of said tens transfer pinion shaft and a fourth semicircular surface area disposed on said base and disposed in engagement with said second end portion of said tens transfer pinion shaft, said shaft positioning surface means on said cover including a third semicircular surface area disposed on said cover and disposed in engagement with said first end portion of said tens transfer pinion shaft and a fourth semicircular surface area disposed on said cover and disposed in engagement with said second end portion of said tens transfer pinion shaft.

4. A totalizer assembly comprising a housing, said housing including a base and a cover connected with said base, said base being integrally molded as one piece, said cover being integrally molded as one piece, a number wheel shaft disposed in said housing, a plurality of number wheels disposed on said number wheel shaft between first and second end portions of said number wheel shaft, a tens transfer pinion shaft disposed in said housing, and a plurality of tens transfer pinions disposed on said tens transfer pinion shaft between first and second end portions of said tens transfer pinion shaft, said base including surface means for engaging said first and second end portions of said number wheel shaft and for engaging said first and second end portions of said tens transfer pinion shaft, said cover including surface means for engaging said first and second end portions of said number wheel shaft and for engaging said first and second end portions of said tens transfer pinion shaft, said surface means on said base and said surface means on said cover cooperating to position and support said number wheel shaft and said tens transfer pinion shaft in said housing, said surface means on said base includes a first arcuate surface area disposed on said base and disposed in engagement with said first end portion of said number wheel shaft and a second arcuate surface area disposed on said base and disposed in engagement with said second end portion of said number wheel shaft, said surface means on said cover including a first arcuate surface area disposed on said cover and disposed in engagement with said first end portion of said number wheel shaft and a second arcuate surface area disposed on said cover and disposed in engagement with said second end portion of said number wheel shaft, said surface means on said base includes a third arcuate surface area disposed on said base and disposed in engagement with said first end portion of said tens transfer pinion shaft and a fourth arcuate surface area disposed on said base and disposed in engagement with said second end portion of said tens transfer pinion shaft, said surface means on said cover including a third arcuate surface area disposed on said cover and disposed in engagement with said first end portion of said tens transfer pinion shaft and a fourth arcuate surface area disposed on said cover and disposed in engagement with said second end portion of said tens transfer pinion shaft.

5. A totalizer assembly as set forth in claim 4 further including a gear train disposed in said housing, said gear train including an input gear rotatable about an axis which extends transversely to central axes of said number wheel shaft and said tens transfer pinion shaft and a number wheel drive gear fixedly connected with one of said number wheels and rotatable about a central axis of said number wheel shaft, said input gear being rotatable relative to said housing to rotate said number wheel drive gear and said one of said number wheels relative to said housing at a rate which varies as a function of the rate of rotation of said input gear.

6. A totalizer assembly as set forth in claim 4 wherein said housing includes a window, said base includes surface means for engaging a first portion of said window and said cover includes surface means for engaging a second portion of said window to hold said window adjacent to said number wheels.

7. A totalizer assembly comprising a housing, said housing including a base and a cover connected with said base, said base being integrally molded as one piece, said cover being integrally molded as one piece, a number wheel shaft disposed in said housing, a plurality of number wheels disposed on said number wheel shaft, a tens transfer pinion shaft disposed in said housing, a plurality of tens transfer pinions disposed on said tens transfer pinion shaft, and a gear train disposed in said housing, said gear train including an input gear disposed in said housing and rotatable about an axis extending transverse to a longitudinal central axis of said tens transfer pinion shaft, and a number wheel drive gear disposed in said housing and driven by said input gear, said number wheel drive gear being connected with one of said number wheels and being rotatable about the longitudinal central axis of said tens transfer pinion shaft, said cover includes surface means for partially supporting said input gear for rotation relative to said housing, said base including surface means for partially supporting said input gear for rotation relative to said housing, said gear train includes an intermediate gear disposed in said housing and rotatable relative to said housing to transmit force between said input gear and said number wheel drive gear, said cover including surface means for partially supporting said intermediate gear for rotation relative to said housing, said base including surface means for partially supporting said intermediate gear for rotation relative to said housing.

8. A totalizer assembly as set forth in claim 7 wherein said number wheels are disposed on said number wheel shaft at locations between first and second end portions of said number wheel shaft, said tens transfer pinions being disposed on said tens transfer pinion shaft at locations between first and second end portions of said tens transfer pinion shaft, said base including surface means for engaging said first and second end portions of said number wheel shaft and for engaging said first and second end portions of said tens transfer pinion shaft, said cover including surface means for engaging said first and second end portions of said number wheel shaft and for engaging said first and second end portions of said tens transfer pinion shaft.

9. A totalizer assembly for use in totaling units at a first rate and for use in totaling units at a second rate which is different than the first rate, said totalizer assembly comprising a housing, said housing including a base and a cover connected with said base, said base being integrally molded as one piece, said cover being integrally molded as one piece, a plurality of number wheels disposed in said housing, a number wheel drive gear disposed in said housing and connected with one of said number wheels, and positioning means for positioning gears of a first gear train in said housing when units are to be totaled at the first rate and for positioning gears of a second gear train in said housing when units are to be totaled at the second rate, said positioning means including a first portion integrally molded as one piece with said base and a second portion integrally molded as one piece with said cover, said first gear train including an input gear, an output gear which engages said number wheel drive gear, and at least one intermediate gear which transmits force along a path extending between said input and output gears, said second gear train including an input gear, an output gear which engages said number wheel drive gear, and at least one intermediate gear which transmits force along a path extending between said input and output gears, said positioning means including a first gear positioning means for positioning said input gear of said first gear train and said input gear of said second gear train for rotation about a first axis, said first gear positioning means including a first bearing surface integrally molded as one piece with said base and a second bearing surface integrally molded as one piece with said cover, second gear positioning means for positioning said output gear of said first gear train and said output gear of said second gear train for rotation about a second axis, said second gear positioning means includes a first bearing surface integrally molded as one piece with said base and a second bearing surface integrally molded as one piece with said cover, third gear positioning means for positioning said intermediate gear of said first gear train for rotation about a third axis, said third gear positioning means including a first bearing surface integrally molded as one piece with said base and a second bearing surface integrally molded as one piece with said cover, and fourth gear positioning means for positioning said intermediate gear of said second gear train for rotation about a fourth axis which is spaced apart from said third axis, said fourth gear positioning means including a first bearing surface integrally molded as one piece with said base and a second bearing surface integrally molded as one piece with said cover.

* * * * *